US006311885B1

(12) United States Patent
Miller

(10) Patent No.: US 6,311,885 B1
(45) Date of Patent: Nov. 6, 2001

(54) BACK PACK WITH A MOISTURE RESISTANT UMBRELLA HOLDER

(76) Inventor: Brian D. Miller, 1610 Bonnycastle Ave., Louisville, KY (US) 40205

( * ) Notice: Subject to any disclaimer, the term of this patent is extended or adjusted under 35 U.S.C. 154(b) by 0 days.

(21) Appl. No.: 09/552,542

(22) Filed: Apr. 19, 2000

(51) Int. Cl.[7] ..... A45F 3/04
(52) U.S. Cl. ..... 224/652; 224/915
(58) Field of Search ..... 224/652, 651, 224/251, 680, 682, 915

(56) References Cited

U.S. PATENT DOCUMENTS

| | | | |
|---|---|---|---|
| 451,843 | | 5/1891 | Powell . |
| 1,094,207 | | 4/1914 | Hollingsworth . |
| 2,369,943 | | 2/1945 | Broudy . |
| 4,301,898 | | 11/1981 | Plough et al. . |
| 4,911,271 | | 3/1990 | Stanley . |
| 5,004,134 | | 4/1991 | Barry . |
| 5,083,644 | | 1/1992 | Collins, III . |
| 5,154,331 | * | 10/1992 | Sanders ..... 224/275 X |
| 5,337,934 | * | 8/1994 | Johnson et al. ..... 224/153 |
| 5,465,743 | | 11/1995 | Sheu et al. . |
| 5,503,476 | | 4/1996 | Hamdan . |
| 6,053,385 | * | 4/2000 | Ward et al. ..... 224/576 |
| 6,193,118 | * | 2/2001 | Kearl ..... 224/153 |

* cited by examiner

*Primary Examiner*—Stephen K. Cronin
(74) *Attorney, Agent, or Firm*—Carrithers Law Office; David W. Carrithers

(57) ABSTRACT

A back pack with an elongate sleeve mounted on the front panel thereof at a readily accessible area and made, at least in part, of an open mesh nylon material. A nylon ring provides an open end for the sleeve through which an umbrella can be inserted in a folded collapsed state. A water impervious layer between the cavity of the sleeve and the panel of the back pack stops water vapor, from a wet umbrella, getting into the back pack storage compartment. A piece of sponge material is located in the sleeve to reduce the amount of moisture run-off from an umbrella returned to the storage sleeve while wet.

9 Claims, 1 Drawing Sheet

BACK PACK WITH A MOISTURE RESISTANT UMBRELLA HOLDER

TECHNICAL FIELD

This invention relates to an improved umbrella holder for removably retaining a damp or wet umbrella in it's folded collapsed state on an external surface portion of a carry all type of bag such as a back pack, book bag, travel bag or the like.

BACKGROUND INFORMATION

The majority of today's carry-all type of bag e.g. back packs, book bags or small hand luggage type bags, are soft-sided and normally made from a durable fabric such as nylon, cotton, denim or the like. The fabrics, while they may be water resistant, they are not waterproof and thus placing a wet umbrella against a wall of the body of the bag can result in the contents in the bag getting damp or wet. This can be very harmful to student's books or detrimental to a hiker expecting a change of dry clothing being carried in the bag or damaging to important paper documents being carried to or from work.

It is known to have a back pack type of bag with an umbrella holding means and by of example reference may be hand to U.S. Pat. No. 5,004,134 issued Apr. 2, 1991 to T. P. Barry.

Other references known to applicant disclosing some means for holding a collapsed umbrella on a hand carry type of bag are as follows:

U.S. patents:

U.S. Pat. No. 451,843 issued May 5, 1891 to G. M. Powell

U.S. Pat. No. 1,094,207 issued Apr. 21, 1914 to C. M. Hollingsworth

U.S. Pat. No. 2,369,943 issued Feb. 20, 1945 to A. M. Broudy

U.S. Pat. No. 4,911,271 issued Mar. 27, 1990 to J. B. Stanley

U.S. Pat. No. 5,083,644 issued Jan. 28, 1992 to C. B. Collins

Not any of the forgoing references are concerned with, nor do they disclose in any form whatsoever, water management for damp or wet umbrellas returned to a umbrella retaining means on a hand or back pack carry all type of bag.

Disclosed in U.S. Pat. No. 5,465,743 issued Nov. 14, 1995 to M Sheu et al is a sheathing device for receiving a wet umbrella. The device includes a flexible tubular member having removable end caps and wherein the water management comprises an orifice in one of the end caps and a removable plug in the orifice for releasing any water that has collected inside the sheath.

Other references considered to be of minor interest in this matter are U.S. Pat. No. 5,503,476 issued Apr. 2, 1996 to S Hamdan, which discloses a laundry carry bag with multiple compartments and side patch pockets with zipper or hook and loop closures and U.S. Pat No. 4,301 issued Nov. 24, 1981 to S. Plough et al which discloses a peace officer's equipment bag with an elastic defining consecutive convolutions on the side of the bag for holding shotgun shells.

SUMMARY OF INVENTION

A principal object of the present invention is to provide a back pack or the like personal type carry bag with an umbrella pocket on the bag's outer surface and including effective water management for wet umbrellas. The instant invention provides for water management in situations involving the return of a wet umbrella to the umbrella storage sleeve on a back pack.

In keeping with the forgoing object there is provided in accordance with the present invention a personal carry type bag having panels connected together and defining at least one article receiving compartment and a sleeve of flexible material attached to one of said panels, said sleeve being located on an outer surface of said bag and defining a cavity for removably receiving therein an umbrella in a folded collapsed condition, at least a portion said flexible material being porous allowing moisture to escape from said cavity, a rim of stiff material secured to said sleeve and circumscribing an open end of said sleeve facilitating insertion and removal of the umbrella, water impervious means separating the sleeve's cavity from the bag's panel to which the flexible material is attached and a piece of water absorbent material in said cavity.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
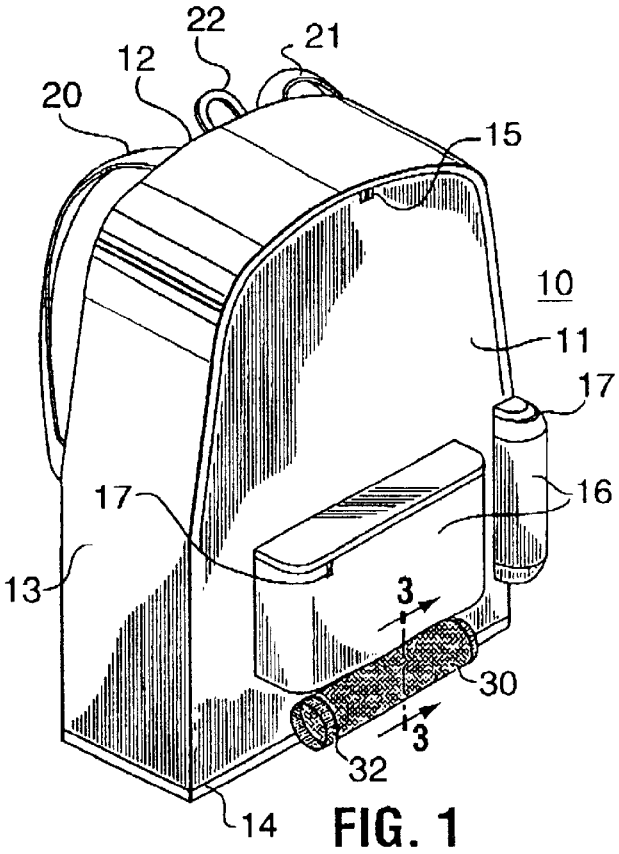
FIG. 1 is an oblique elevation view of a back pack provided with an umbrella receiving sleeve of the present invention.

Referring to the drawing there is illustrated a back pack 10 comprising a shell composed of a front panel 11 and a rear panel 12 joined together by an edge panel 13 and a bottom wall 14. The panels together with the bottom wall define an article receiving cavity with access thereto through an opening having a zipper closure 15. There are one or more patch pockets 16(two being shown in FIG. 1) on the outer surface of the bag as is conventional in the art and each is provided with a zipper closure 17 for securing articles in the pocket.

The panels are of durable fabric such as nylon but obviously there are many known other suitable materials.

The bag is carried by a pair of shoulder straps designated respectively 20 and 21, or a finger loop 22, all of which are suitably attached as for example to the rear panel 12.

A sleeve 30, made of flexible material, is secured to the front panel 11 and provides a cavity 31 for removably receiving an umbrella 40. The sleeve 30 has a ring 32 (or short sleeve) of stiff or rigid material, e g a plastics material, defining an open end of the sleeve which facilitates insertion and removal of the umbrella. At least a portion of the flexible material, defining the sleeve, is an open weave or nylon open mesh to allow quick evaporation of moisture and permit good breathability.

Figure 2:
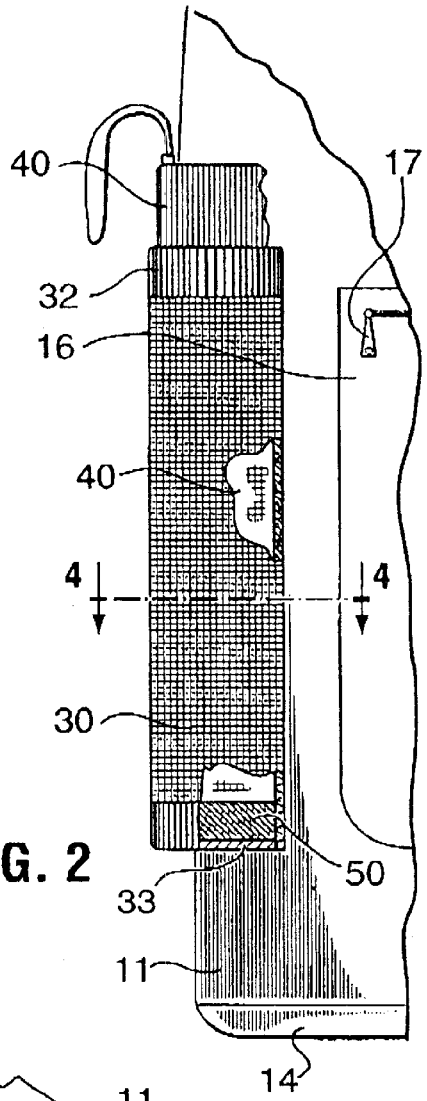
FIG. 2 is an elevation partial view of a back pack with the umbrella storage sleeve at a different location.

The sleeve 30 may be variously located on the bag and variously orientated. For example the sleeve may be disposed horizontally and located at the lower center of the front panel of the bag as illustrated in FIG. 1 or disposed vertically and adjacent an outer edge of the bag as illustrated in FIG. 2. The vertically disposed sleeve is closed at it's bottom end by an end cap 33 which is fixed to the sleeve defining flexible material in any convenient manner.

Figure 3:
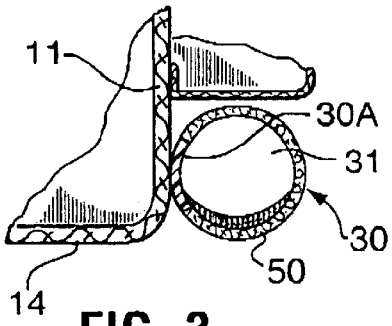
FIG. 3 is a sectional view taken along line 3—3 of FIG. 1.
Figure 4:
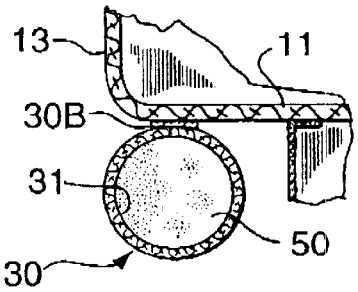
FIG. 4 is a sectional view taken along line 4—4 of FIG. 2.

As previously indicated at least a portion of the sleeve is of porous, preferably open mesh or open weave, material. In FIG. 3 the sleeve 30 is illustrated with a water impervious portion 30A abutting the front panel 11. This water impervious portion is secured to the bag as by welding, gluing and/or stitching and helps prevent moisture from entering the content storage compartment of the back pack. In the embodiment illustrated in FIG. 4 the entire sleeve, except for the bottom cap and the top end ring, is an open mesh material and the sleeve is attached to the bag panel 11 by a water impervious strip of adhesive 30B. A water resistant coating can also be used in addition to the forgoing and/or in place thereof to separate the sleeve cavity from the bag storage compartment and thereby prevent moisture from a wet umbrella getting into the bag storage area.

Finally in order to reduce the amount of moisture or water run-off form a wet umbrella returned to the sleeve a piece of water absorbent material 50 (for example a sponge) is located in a lower portion of the cavity provided by the sleeve. The positioning of the sponge is dependent upon the orientation of the sleeve on the bag. With the sleeve vertical as shown in FIG. 2 the piece of sponge rests on the bottom end cap 33. The sponge can either be loosely fitted in place and thereby readily replaceable or be more securely fastened as will be required with the horizontally disposed sleeve shown in FIG. 1 and in which the sponge is a strip extending length wise an the lower inner surface of the sleeve.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A back pack with a moisture resistant umbrella holder, comprising: a personal carry type bag having a front panel, a rear panel and a bottom wall connected together to define at least one article storage compartment, flexible material defining a sleeve that is open at one end, means mounting said sleeve on one of said panels at a readily accessible location on an outer surface of the bag, said sleeve providing a cavity for removably receiving therein an umbrella inserted though said open end in a folded collapsed state, at least a portion of said flexible material being an open mesh type of material and water impervious means separating the cavity of the sleeve from the panel of the bag to which the sleeve is attached.

2. The back pack and moisture resistant umbrella holder of claim 1, including a ring of stiff material attached to said sleeve and defining said open end.

3. The back pack and moisture resistant umbrella holder of claim 1, including a piece of water absorbent material located in said cavity.

4. The back pack and moisture resistant umbrella holder of claim 1, wherein said sleeve is attached to said front panel and including at least one shoulder strap attached to said rear panel.

5. The back pack and moisture resistant umbrella holder of claim 4, wherein said panels are a fabric material.

6. The back pack and moisture resistant umbrella holder of claim 4, wherein said panels are a light weight nylon material.

7. The back pack and moisture resistant umbrella holder of claim 4, wherein said elongate sleeve is disposed vertically.

8. The back pack and moisture resistant umbrella holder of claim 4, wherein said elongate sleeve is disposed horizontally.

9. The back pack and moisture resistant umbrella holder of claim 4, wherein said ring is a nylon sleeve.

* * * * *